US005483702A

United States Patent [19]

D'Ambrosio

[11] Patent Number: 5,483,702

[45] Date of Patent: Jan. 16, 1996

[54] GARMENT WAISTBAND CONSTRUCTION

[76] Inventor: Anthony D'Ambrosio, 6405 N. Broad St., Philadelphia, Pa. 19126

[21] Appl. No.: 343,344

[22] Filed: Nov. 22, 1994

[51] Int. Cl.[6] ..... A41D 1/06

[52] U.S. Cl. ..... 2/237; 2/221; 428/193

[58] Field of Search ..... 2/237, 236, 221, 2/220, 76, 275, 338; 66/172 E, 172 R, 173; 428/192, 193

[56] References Cited

U.S. PATENT DOCUMENTS

| | | | |
|---|---|---|---|
| 2,195,894 | 4/1940 | Moore . | |
| 2,277,227 | 3/1942 | Hardie . | |
| 2,708,274 | 5/1955 | Vander et al. . | |
| 2,757,381 | 8/1956 | Cottier et al. . | |
| 3,571,814 | 3/1971 | Miller | 2/236 |
| 3,663,963 | 5/1972 | Miller . | |
| 3,723,993 | 4/1973 | Ruby . | |
| 3,813,698 | 6/1974 | Campbell, Jr. et al. . | |
| 3,848,268 | 11/1974 | D'Ambrosio . | |
| 3,868,729 | 3/1975 | Lynam . | |
| 3,869,728 | 3/1975 | Spencer . | |
| 4,332,034 | 6/1982 | Muse | 2/237 |
| 4,549,317 | 10/1985 | D'Ambrosio . | |
| 4,970,728 | 10/1990 | D'Ambrosio . | |

*Primary Examiner*—C. D. Crowder
*Assistant Examiner*—Gloria Hale
*Attorney, Agent, or Firm*—Woodcock Washburn Kurtz Mackiewicz & Norris

[57] ABSTRACT

An improved waistband construction for garments including a new one-piece flat elastic strip having middle and lower portions of different stretchability and a lip portion integral with the middle portion which extends above the edge of the middle portion and has a stretchability between the stretchability of the middle and lower portions of the elastic strip.

14 Claims, 1 Drawing Sheet

GARMENT WAISTBAND CONSTRUCTION

FIELD OF THE INVENTION

This invention relates to the manufacture of waistbands for garments and more particularly to an improved waistband construction which provides for ease in assembly and improved appearance and comfort and whereby a single garment may be manufactured so as to properly fit persons varying over several standard waist sizes.

BACKGROUND OF THE INVENTION

The present invention is an improvement over the invention disclosed in my U.S. Pat. No. 4,970,728 which in turn was an improvement over the inventions disclosed in my U.S. Pat. No. 4,549,317 and in my U.S. Pat. No. 3,848,268.

The constructions shown in my previous patents have all enjoyed substantial success. In my U.S. Pat. No. 4,970,728 I discovered that I could eliminate the fabric curtain by using a new one-piece flat elastic strip having upper and lower portions of different stretchability and in doing so provide an improved waistband construction by which a single garment would fit persons having a wide range of waist sizes. In that patent I disclosed a waistband construction utilizing a strip of stiffening elastic material in addition to the one-piece flat elastic strip having upper and lower portions of different stretchability. This second strip reduced the overall stretchability as well as adding to the cost of material and assembly. I have now discovered that by modifying my one-piece elastic strip to include a lip portion with different stretchability so as to create a bifurcated edge on the elastic strip I can increase the flexibility, reduce the cost and time in assembling the waistband and improve the overall appearance and comfort of the waistband. My new waistband construction provides for easier finish pressing of the garment and is cosmetically cleaner both inside and outside. My improved waistband construction is applicable for all waistband garments for men, women and children including fine dress garments, work clothes and uniforms and provides a stretchability of about 2 to 4 inches in waistband size. After the waistband has been stretched it has the ability to return to the original size when the garment is removed.

SUMMARY OF THE INVENTION

In accordance with the present invention there is provided a waistband assembly for a garment comprising a waistband of a fabric material turned over at its upper extremity to form a U-shaped bight with a small inner flap depending therefrom. The assembly includes an elastic strip of one-piece construction having a middle portion which is longitudinally elastic including means substantially preventing transverse bending of the middle portion thereby to exhibit no-roll characteristics. The middle portion has an integral lip extending from a location below the edge of the middle portion to a location above the edge of the middle portion to form a bifurcated edge on the elastic strip. The lip is inserted into the U-shaped bight with the middle portion being positioned adjacent to and sewn to the side of the inner flap and the integral lip, facing inwardly to the wearer away from the waistband at the top of the strip. The elastic strip has a lower portion extending below the lower edge of the waistband, the lower portion of the elastic strip and the lip offering a lower resistance to elongation than the middle portion of the elastic strip. In accordance with one aspect of the invention the fabric material comprising the waistband is cut on a bias angle of about 30° to about 50° and the inner surface of the fabric material of the waistband is provided with an adhesive-fused backing material, the backing material having low stretchability in the transverse direction and high stretchability in the longitudinal direction.

In accordance with another aspect of the invention, there is provided in a waistband assembly for a garment, the improvement comprising an elastic strip of one-piece construction having a middle portion which is longitudinally elastic including means substantially preventing transverse bending of the middle portion thereby to exhibit no-roll characteristics. The elastic strip has a lower portion offering a lower resistance to elongation then the middle portion of the elastic strip and the middle portion has an integral lip extending from a location below the edge of the middle portion to a location above the edge of the middle portion to form a bifurcated edge on the elastic strip, the integral lip offering a lower resistance to elongation than the middle portion of the elastic strip. The ratio of the width of the middle portion of the elastic strip to the lower portion of the elastic strip is about 4 to 1 and the width of the lip is greater than the width of the lower portion. The lower portion of the elastic strip has a degree of stretchability with respect to the middle portion of the elastic strip within the range of about 2 to 1 to about 1.3 to 1 and the lip has a degree of stretchability less than the lower portion of the elastic strip. The lip portion of the elastic strip has a stretchability of about 65%±10% and the middle portion of the elastic strip has a stretchability of about 50%±10% and the lower portion of the elastic strip has a stretchability of about 85%±10%.

For a more detailed disclosure of the invention and for further objects and advantages thereof, reference is to be had to the following description taken in conjunction with the accompanying drawings.

DESCRIPTION OF THE PREFERRED EMBODIMENT

As pointed out above, the present invention is an improvement over my prior waistband construction disclosed in my aforesaid U.S. Pat. No. 4,970,728. The disclosure in that patent is incorporated herein by this reference thereto. Accordingly, where a specific constructional detail is not specified herein, it may in general be assumed that the construction is similar to that previously shown.

Figure 1:
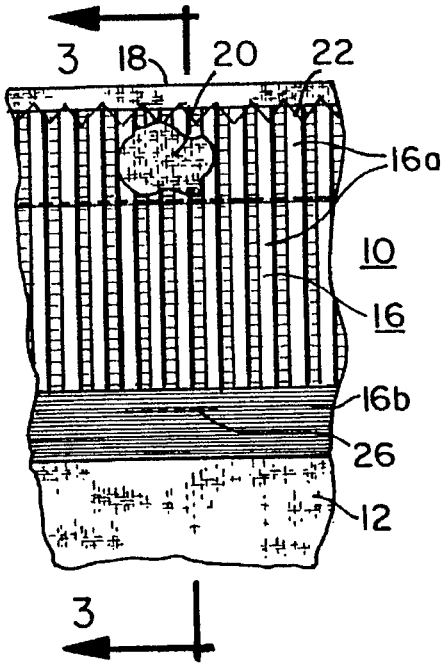
FIG. 1 is a fractional view of a portion of the improved waistband construction and garment facing inwardly to the wearer.
Figure 2:
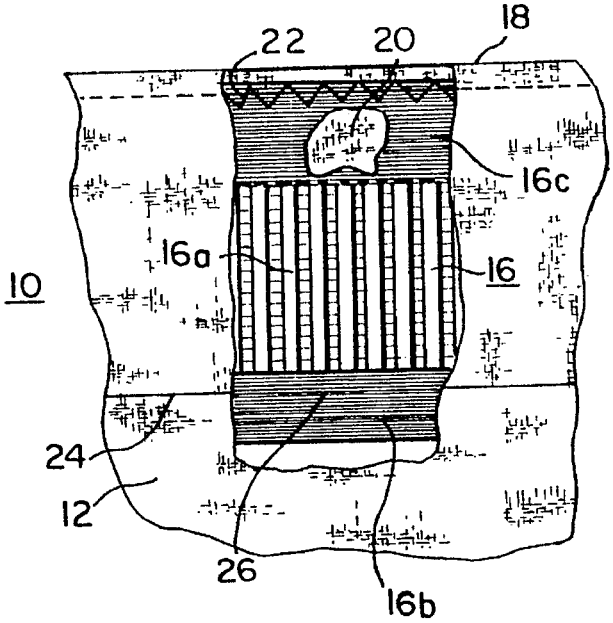
FIG. 2 is a fractional view of a portion of the waistband and garment taken from the reverse side of FIG. 1 with an area broken away to show the inner construction of the waistband.

Referring to FIGS. 1 and 2 there is shown the inside and outside of my improved waistband assembly 10 for a garment. The waistband assembly 10 is attached to the garment shell 12. The fabric of the waistband assembly 10 and the lower shell 12 are of the same material. Any material is suitable and it is not limited to what is known in the trade as stretchable material. To provide for stretchability in the waistband fabric, the fabric is cut on a bias angle of about 30° to about 50° and the inner surface or face of the fabric material of the waistband is provided with an adhesive-fused backing material 14. The backing material 14 may be tricot knit, woven or non-woven and has low stretchability in the transverse direction and high stretchability in the longitudinal direction which permits elongation of the waistband 10.

Figure 4:
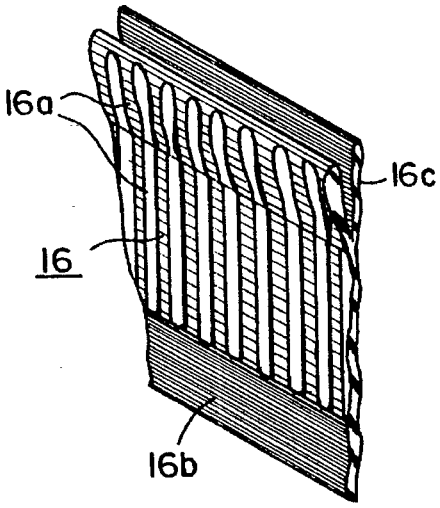
FIG. 4 is a perspective view of the new elastic strip of one-piece construction utilized in the new waistband assembly shown in FIGS. 1–3.

Referring to FIG. 4 there is illustrated the new elastic strip 16 used in my improved waistband assembly. The elastic strip 16 is of one-piece construction having a middle portion 16*a* which is longitudinally elastic including rib structure substantially preventing transverse bending of the middle portion thereby to exhibit no-roll characteristics. The elastic strip 16 includes a lower portion 16*b* which offers a lower resistance to elongation than the middle portion 16*a* of the elastic strip 16. The strip 16 also includes an integral lip 16*c* which extends from a location below the edge of the middle portion 16*a* to a location above the edge of the middle portion 16*a* to form a bifurcated edge on the elastic strip 16. The integral lip 16*c* offers a lower resistance to elongation than the middle portion 16*a* of the elastic strip 16. The lower portion 16*b* of the elastic strip 16 has a degree of stretchability with respect to the middle portion 16*a* of the elastic strip within the range of about 2 to 1 to about 1.3 to 1 and the lip 16*c* has a degree of stretchability similar to but preferably lower than the lower portion 16*b* of the elastic strip 16. The ratio of the width of the middle portion 16*a* of the elastic strip 16 to the lower portion 16*b* of the elastic strip 16 is about 4 to 1 and the width of the lip 16*c* is greater than the width of the lower portion 16*b*. It will be noted that the upper edge of the lip 16*c* extends above the upper edge of the middle portion 16*a* and the purpose of this will hereinafter be pointed out.

Figure 3:
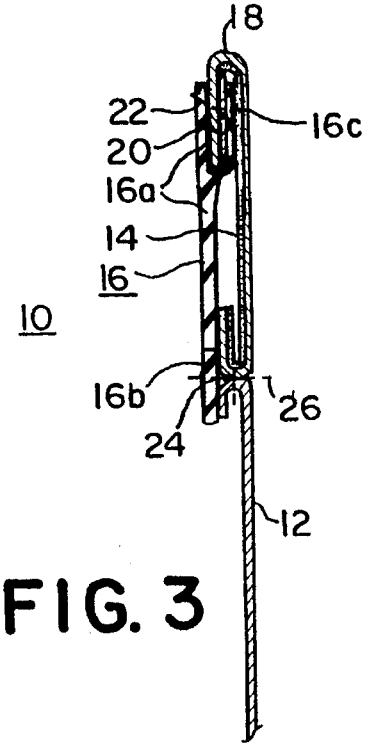
FIG. 3 is a sectional view taken along the lines 3—3 in FIG. 1.

Referring to FIG. 3 it will be seen that the fabric material of the waistband 10 including the backing material 14 is turned over at its upper extremity to form a U-shaped bight 18 with a small inner flap 20 depending therefrom. The flap 20 is inserted over the lip 16*c* on the elastic strip 16 and is positioned between the lip 16*c* and the upper edge of the middle portion 16*a*. The middle portion 16*a* is sewn to the side of the inner flap 20 facing inwardly to the wearer away from the waistband at the top of the strip 16 and also to the lip 16*c*. This is facilitated by the use of a guide. As may be seen in FIG. 3 the stitching 22 joins the middle portion 16*a* of the elastic strip with the depending flap 22 and the lip 16*c* but does not extend through the outer or exposed face of the waistband 10. By making the lip 16*c* extend above the upper edge of the middle portion 16*a* of the elastic strip 16 it is assured that the bight 18 will extend above the upper edge of the middle portion 16*a* of the elastic strip so as to conceal the elastic strip 16 from view when the garment is worn and thus assuring an attractive appearance of the waistband. By forming the lip 16*c* integral with the elastic strip 16, this permits the inner flap 20 to be sewn inside of the lip 16*c* thus assuring that the edge of the fabric material and backing 14 in the flap 20 will not fray. Also no trimming of the fabric material is required as it is located between the lip 16*c* and the upper edge of the elastic strip 16.

The integral strip 16 also has additional advantages over the construction shown in my aforesaid U.S. Pat. No. 4,970,728. In that patent I utilized a separate strip of stiffening elastic material. This required additional cost for the separate strip and also increased the cost in assembling the separate strip with the other elements of the waistband construction. In pressing the waistband with a separate strip, there was a line showing on the outside of the waistband. With my new construction with the integral lip, this line is eliminated and when the waistband is pressed it presents a smooth finish on the outside of the waistband.

The elastic strip 16 also includes a lower portion 16*b* extending below the lower edge of the waistband 10. The lower portion 16*b* of the elastic strip 16 is also longitudinally elastic in the form of flat woven elastic webbing and has the characteristic of offering a lower resistance to elongation than the middle portion 16a of the elastic strip 16. The lower resistance allows the elastic strip to conform with the curve of the body and avoids creating a pull or bind in that area. The elastomer used in the elastic strip 16 may be of Spandex or Lycra and polyester or equivalent. In a preferred form of the invention, the lower portion 16*b* has a width of about ⅜" to ½" and a stretchability of about 85% with a range of + or −10% and the middle portion 16*a* has a width of about 1½" to 2" with a stretchability of about 50% with a range of + or −10%. The lip 16*c* has a width of about ⅝" with a stretchability of about 65% with a range of + or −10% and as shown in FIGS. 3 and 4 extends above the upper edge of the middle portion 16*a* of the strip 16.

Referring to FIGS. 1–3 it will be seen that the shell portion 12 of the fabric material is joined to the lower edge of the waistband 10 by the stitching 24 at a location above the lower edge of the elastic strip 16. The stitching 24 forms a seam extending around the garment and forms a juncture between the shell portion 12 of the fabric and the lower edge of the waistband 10. While the upper edge of the elastic strip 16 is stitched at 22 to the waistband 10 around the entire length, the elastic strip 16 is only stitched at periodic intervals around the waistband 10 to the juncture between the shell 12 and the lower edge of the waistband 10 to prevent restriction of stretch. The periodic stitching is illustrated at 26 and is referred to as a "crack" stitch.

While a preferred embodiment of the garment waistband construction has been described and illustrated, it is to be understood that further modifications thereof may be made within the scope of the appended claims.

What is claimed is:

1. In a waistband assembly for a garment, the improvement comprising an elastic strip of one piece construction having a middle portion which is longitudinally elastic including means substantially preventing transverse bending of said middle portion thereby to exhibit no-roll characteristics, said elastic strip having a lower portion offering a lower resistance to elongation than the middle portion of said elastic strip, and said middle portion having an integral lip extending from a location below the edge of said middle portion to a location above the edge of said middle portion to form a bifurcated edge on said elastic strip, said integral lip offering a lower resistance to elongation than the middle portion of said elastic strip.

2. The improvement according to claim 1 wherein the ratio of the width of the middle portion of said elastic strip to the lower portion of said elastic strip is about 4 to 1 and the width of said lip is greater than the width of said lower portion.

3. The improvement according to claim 1 wherein said lower portion of said elastic strip offers a lower resistance to elongation than said integral lip.

4. The improvement according to claim 3 wherein said middle portion of said elastic strip has a stretchability of about 50% and said lower portion of said elastic strip has a stretchability of about 85% and said lip have a stretchability of about 65%.

5. A waistband assembly for a garment comprising a waistband of a fabric material turned over at its upper extremity to form a U-shaped bight with a small inner flap depending therefrom, and an elastic strip of one piece construction having a middle portion which is longitudinally elastic including means substantially preventing transverse bending of said middle portion thereby to exhibit no-roll characteristics, said middle portion having an integral lip extending from a location below the edge of said middle portion to a location above the edge of said middle portion to form a bifurcated edge on said elastic strip, said lip being inserted into said U-shaped bight with said middle portion being positioned adjacent to and sewn to the side of said inner flap and said integral lip, facing inwardly to the wearer away from said waistband at the top of said strip, said elastic strip having a lower portion extending below the lower edge of said waistband, said lower portion of said elastic strip of said lip offering a lower resistance to elongation than the middle portion of said elastic strip.

6. A waistband assembly for a garment according to claim 5 wherein said fabric material comprising said waistband is cut on a bias angle of 30° to 50°.

7. A waistband assembly for a garment according to claim 5 wherein the inner surface of said fabric material of said waistband is provided with an adhesive-fused backing material, said backing material having low stretchability in the transverse direction and high stretchability in the longitudinal direction.

8. A waistband assembly for a garment according to claim 5 wherein the ratio of the width of the middle portion of said elastic strip to the lower portion of said elastic strip is about 4 to 1 and the width of said lip is greater than the width of said lower portion.

9. A waistband assembly for a garment according to claim 5 wherein said lower portion of said elastic strip has a degree of stretchability with respect to said middle portion of said elastic strip within the range of about 2 to 1 to about 1.3 to 1 and wherein said lip has a degree of stretchability less than said lower portion of said elastic strip.

10. A waistband assembly for a garment according to claim 5 wherein said middle portion of said elastic strip has a stretchability of about 50%, said lower portion of said elastic strip has a stretchability of about 85% and said lip has a stretchability of about 65%.

11. An elastic strip for use in a waistband assembly for a garment comprising an elastic strip of one-piece construction having a middle portion which is longitudinally elastic including means substantially preventing transverse bending of said middle portion thereby to exhibit no-roll characteristics, said elastic strip having a lower portion offering a lower resistance to elongation than the middle portion of said elastic strip, and said middle portion having an integral lip extending from a location below the edge of said middle portion to a location above the edge of said middle portion to form a bifurcated edge on said elastic strip, said integral lip offering a lower resistance to elongation than the middle portion of said elastic strip.

12. An elastic strip according to claim 11 wherein the ratio of the width of the middle portion of said elastic strip to the lower portion of said elastic strip is about 4 to 1 and the width of said lip is greater than the width of said lower portion.

13. An elastic strip according to claim 11 wherein said lower portion of said elastic strip offers a lower resistance to elongation than said integral lip.

14. An elastic strip according to claim 13 wherein said middle portion of said elastic strip has a stretchability of about 50% and said lower portion of said elastic strip has a stretchability of about 85% and said lip have a stretchability of about 65%.

* * * * *